US009162496B2

(12) United States Patent
Muro

(10) Patent No.: US 9,162,496 B2
(45) Date of Patent: Oct. 20, 2015

(54) PRINTING METHOD AND PRINTING APPARATUS

(71) Applicant: CANON KABUSHIKI KAISHA, Tokyo (JP)

(72) Inventor: Kentarou Muro, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/250,633

(22) Filed: Apr. 11, 2014

(65) Prior Publication Data

US 2014/0307019 A1 Oct. 16, 2014

(30) Foreign Application Priority Data

Apr. 16, 2013 (JP) ..... 2013-085957

(51) Int. Cl.
*B41J 11/42* (2006.01)
*B41J 11/66* (2006.01)
*B41J 11/46* (2006.01)

(52) U.S. Cl.
CPC ..... *B41J 11/663* (2013.01); *B41J 11/46* (2013.01)

(58) Field of Classification Search
CPC ..... B41J 11/663; B41J 11/68
USPC ..... 347/16, 20
See application file for complete search history.

(56) References Cited

U.S. PATENT DOCUMENTS

| | | | | |
|---|---|---|---|---|
| 8,833,893 | B2 * | 9/2014 | Okamoto et al. | 347/16 |
| 2011/0211899 | A1 * | 9/2011 | Teshigawara et al. | 400/621 |
| 2011/0211900 | A1 * | 9/2011 | Ueda et al. | 400/621 |
| 2012/0194597 | A1 | 8/2012 | Okamoto et al. | |

FOREIGN PATENT DOCUMENTS

| | | | |
|---|---|---|---|
| JP | 2000214541 A | * | 8/2000 |
| JP | 2012-158122 A | | 8/2012 |

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A printing method and apparatus can achieve both of highly reliable detection of a mark and suppression of a sheet consumption amount when a continuous sheet is cut on an image basis after a plurality of images has been printed on the continuous sheet. For this purpose, at the time of arranging a non-image area including a cut mark between two images to be successively printed, the length of the non-image area in a conveyance direction is set on the basis of the length of a precedently conveyed image in the conveyance direction and image data in a rear end part of the image.

7 Claims, 11 Drawing Sheets

CONVEYANCE DIRECTION
20b
20a
12
21
M
IMAGE A
IMAGE B
IMAGE C

R/2

M

CUTTING POSITION 1

CUTTING POSITION 2
CUTTING POSITION 4
CUTTING POSITION 3

PRINTING METHOD AND PRINTING APPARATUS

BACKGROUND OF THE INVENTION

1. Field of the Invention

The present invention relates to a printing apparatus and printing method that print a plurality of images on a continuous sheet and cut the sheet on a page basis.

2. Description of the Related Art

There has been provided a printing apparatus that sequentially prints a plurality of images on a continuous sheet, and cuts the sheet on an image (page) basis. In such a printing apparatus, a conveyance state of the continuous sheet is influenced by an individual difference of the printing apparatus, the type or width of the sheet, use environment, or the like, and therefore a conveyance distance of the continuous sheet per unit time includes a certain amount of error. For this reason, in order to prevent the continuous sheet from being cut in the middle of an image, a method that, between images, provides a non-image area formed with a cut mark indicating a cutting position, and on the basis of the timing when a detector detects the cut mark, cuts the continuous sheet with a cutter is used.

However, in the case where in order to detect such a cut mark, the detector performs a reading operation throughout the continuous sheet, a pattern in an image, which is similar to the cut mark, may also be determined as the cut mark to cut the continuous sheet in the middle of the image.

To address such a problem, Japanese Patent Laid-Open No. 2012-158122 discloses a method that performs a reading operation by a detector only on a non-image area printed with a cut mark. Also, Japanese Patent Laid-Open No. 2012-158122 discloses a configuration where by focusing on the fact that an error in conveyance amount of a continuous sheet is increased along with an increase in conveyance distance of the continuous sheet, i.e., an increase in size of a precedently printed image, a size of a non-image area between two successive images is adjusted depending on a size of a precedent image. According to such Japanese Patent Laid-Open No. 2012-158122, in a non-image area having length enough to include a conveyance error of the continuous sheet, a cut mark can be detected, and therefore even in the case where a conveyance error occurs, the continuous sheet can be cut in a correct position.

However, with the configuration of Japanese Patent Laid-Open No. 2012-158122, as a size of an image is increased, a non-image area finally cut off also increases to increase a sheet consumption amount, and therefore to suppress this, further improvement is required.

SUMMARY OF THE INVENTION

The present invention is made in order to solve the above-described problem, and an object thereof is to, when a continuous sheet is cut on an image basis after a plurality of images has been printed on the continuous sheet, achieve both of highly reliable detection of a mark and suppression of a sheet consumption amount.

In a first aspect of the present invention, there is provided a printing method comprising: printing a plurality of images on a continuous sheet and forming a mark in a non-image area between adjacent two images; and cutting the sheet on a basis of a detection of the mark, wherein a length of the non-image area is set on a basis of image data in a rear end part of a precedent image of the two images.

In a second aspect of the present invention, there is provided a printing apparatus comprising: a printing unit configured to print a plurality of images on a continuous sheet, and form a mark in a non-image area between adjacent two images; and a cutting unit configured to cut the sheet on a basis of detection of the mark, wherein length of the non-image area is set on a basis of image data in a rear end part of a precedent image of the two images.

Further features of the present invention will become apparent from the following description of exemplary embodiments (with reference to the attached drawings).

DESCRIPTION OF THE EMBODIMENTS

Figure 1:
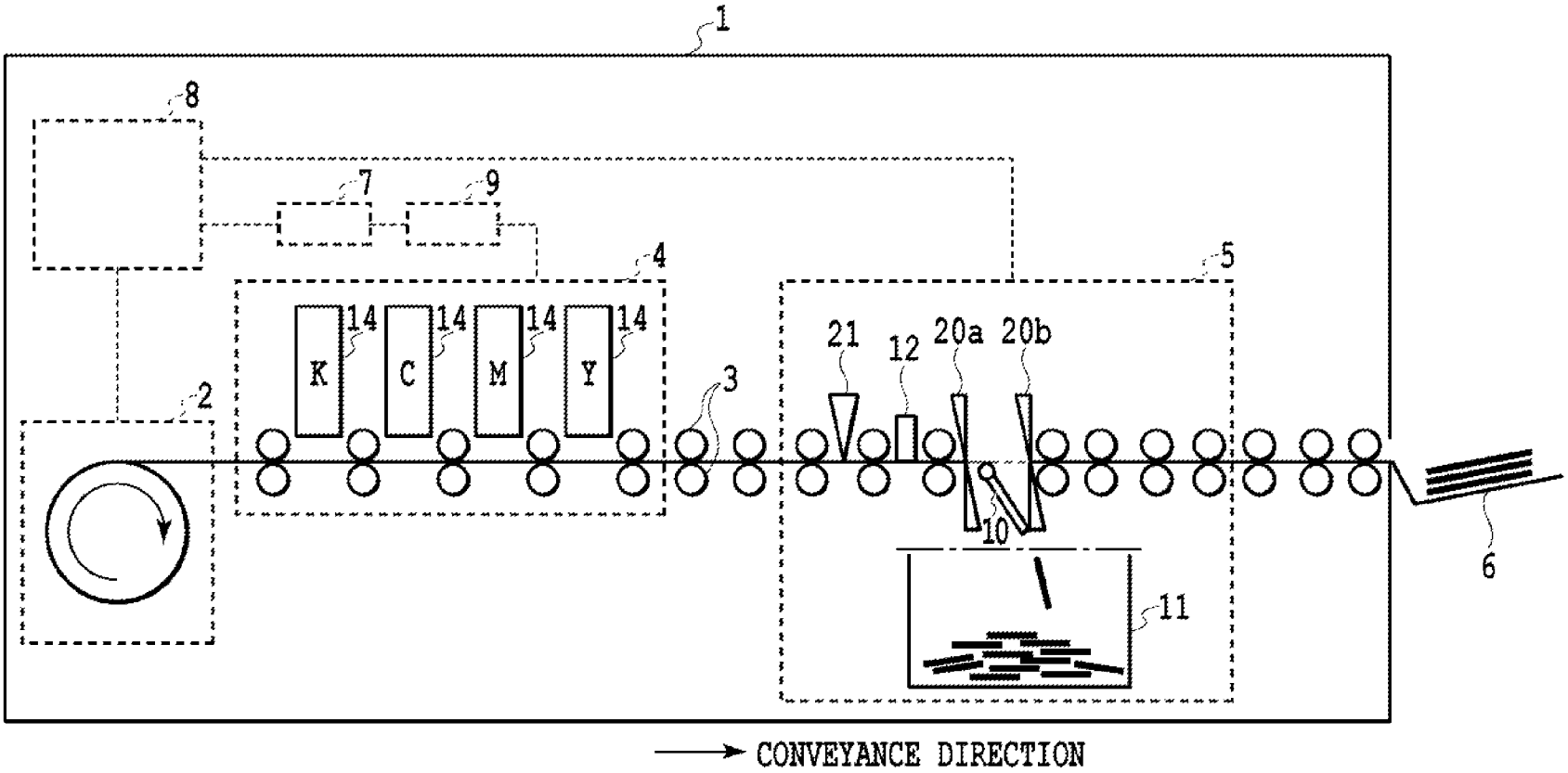
FIG. 1 is a cross-sectional view illustrating an internal configuration of a printing apparatus usable in the present invention.

FIG. 1 is a cross-sectional view illustrating an internal configuration of a printing apparatus 1 usable in the present invention. A sheet feeding unit 2 containing a continuous sheet in a roll shape draws the continuous sheet to feed the sheet to a conveyance path. In the conveyance path, a plurality of pairs of conveyance rollers 3 is disposed to convey the continuous sheet or a cut sheet after cutting from left to right in the cross-sectional view.

A printing unit 4 ejects ink from a print head 14 to print an image on the continuous sheet under conveyance. In addition to printing such image data, the print head 14 also prints a cut mark indicating a position to cut the continuous sheet, a test pattern for checking a print state of the print head, and the like.

The print head 14 of the present embodiment includes an inkjet type line head in which a plurality of nozzles ejecting ink are arrayed in a direction intersecting with a sheet conveyance direction within a range covering a maximum width of a sheet supposed to be used. Further, such line heads are parallel arranged in the conveyance direction corresponding to the number of ink colors. In the present embodiment, it is assumed that four line heads corresponding to four colors of K (black), C (cyan), M (magenta), and Y (yellow) are provided. Inks of the respective colors are supplied from unillustrated ink tanks to the print head 14 through ink tubes.

A cutter unit 5 is provided with: an edge sensor 21 that detects a sheet fore end; a cut mark sensor 12 that detects a cut mark on the sheet; and two cutters 20*a* and 20*b* that cut the sheet on the basis of a location of the cut mark detected by the cut mark sensor 12. The cutters 20*a* and 20*b* are arranged with being separated into upstream and downstream sides, and respectively cut fore and rear end sides of an image according to the cut mark printed on the sheet. A cut sheet after the cutting, i.e., an image sheet (page) is discharged to a discharge tray 6 by a plurality of conveyance rollers. On the other hand, a non-image sheet between images is contained in a trash box 11. Such conveyance path switching between an image sheet and a non-image sheet is performed by a flapper mechanism 10.

The control unit 8 is a unit that controls the whole of the printing apparatus 1. The control unit 8 performs a predetermined process on image data received from a host device or the like connected to the outside, and after converting to image data printable by the printing apparatus 1, controls the respective units to perform a printing operation.

An image analyzing unit 7 performs a distinctive image analysis of the present invention on image data processed by the control unit 8 and transmits a result of the analysis to a data processing unit 9. The analysis will be described later in detail.

A data processing unit 9 determines the length of a non-image area provided between images on the basis of information obtained from the image analyzing unit 7. Also, the data processing unit 9 generates print data where a cut mark is arranged in the non-image area, and in a state of combining the print data with image data, converts the series of pieces of data to data in a bitmap format to transmit the data to the printing unit 4.

Figure 2:
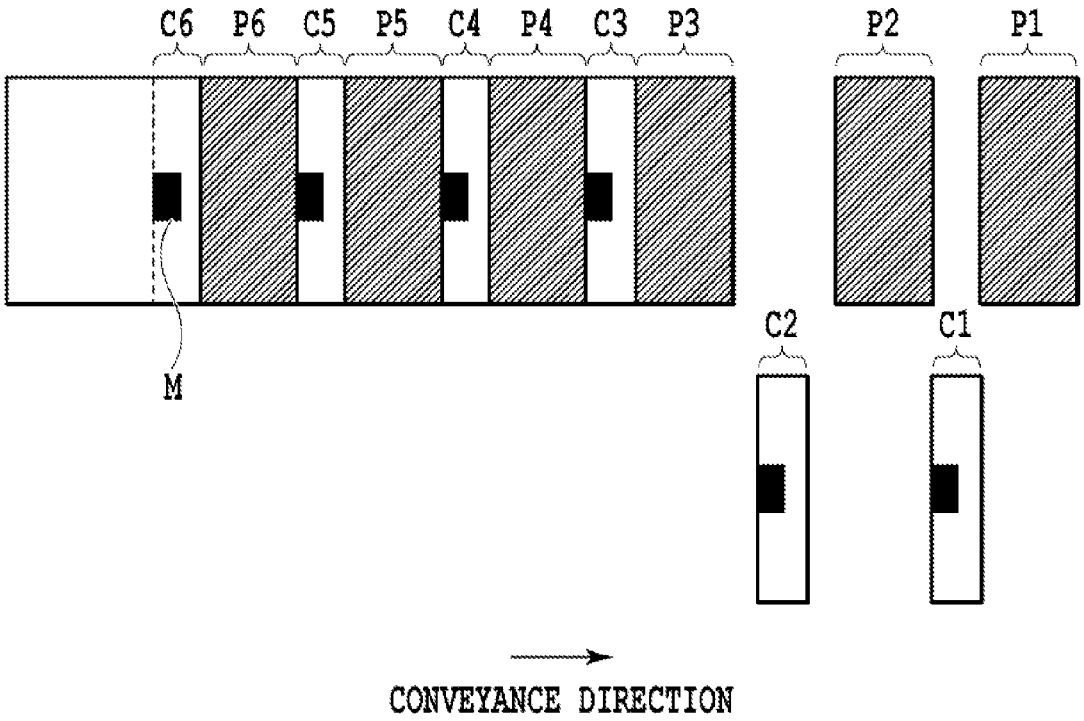
FIG. 2 is a diagram illustrating a typical layout of images printed on a continuous sheet and non-image areas.

FIG. 2 is a diagram illustrating a typical layout of image and non-image areas that are generated by the data processing unit 9 and printed on the continuous sheet. FIG. 2 illustrates the case of successively printing images P1 to P6 having comparable lengths. The data processing unit 9 provides non-image areas C1 to C6 between any adjacent two of the images P1 to P6, and on a downstream side of each of the non-image areas C1 to C6, a cut mark M is arranged. The continuous sheet subjected to a printing operation according to data where such a layout is provided is then, in the cutter unit 5, cut at fore and rear end parts of each of the non-image areas C1 to C6 according to a corresponding one of the cut marks M as a guide. As a result, the images P1 to P6 and the non-image areas C1 to C6 are separated from each other.

Figure 3A:
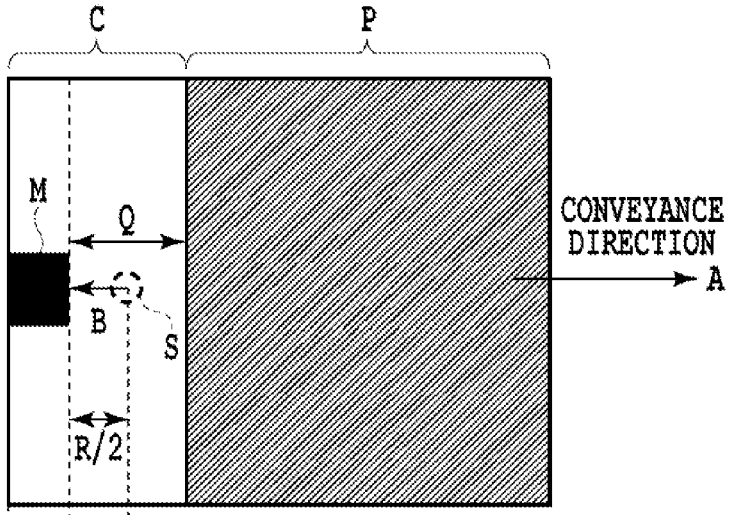
FIGS. 3A and 3B are diagrams illustrating a situation of detecting a cut mark.
Figure 3B:
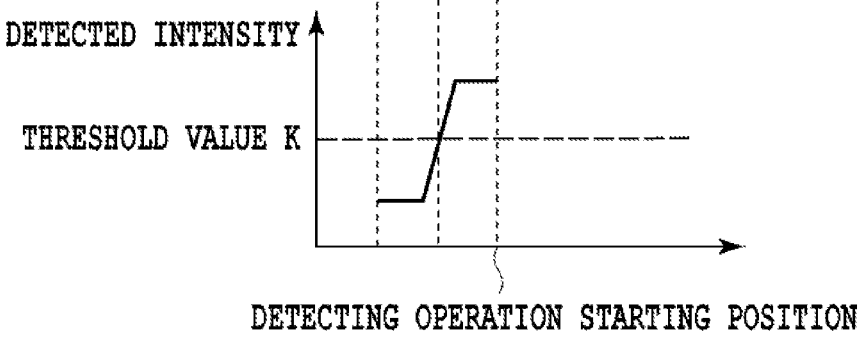

FIGS. 3A and 3B are diagrams respectively illustrating a situation where the cut mark sensor 12 detects a cut mark M in the cutter unit 5 and a result of the detection. The cut mark sensor 12 is an optical sensor having an irradiation part and a light receiving part, and is structured to detect a cut mark on the basis of a change in received light intensity of reflected light from a sheet. As a light source, a small-sized semiconductor light source (LED, OLED, semiconductor laser, or the like) is suitable, and the cut mark M is preferably printed with a color having a high light absorption distribution characteristic with respect to a wavelength of the light source. For example, in the case where the light source is a red LED, as the cut mark M, it is suitable to print a solid image with use of a black ink having a high light absorption distribution characteristic with respect to a red color.

Referring to FIG. 3A, the cut mark sensor 12 measures the intensity of light reflected at a surface of the continuous sheet with a detection area S of the cut mark sensor 12 moving in a B direction with respect to the continuous sheet conveyed in an A direction. In this case, when the detection area S is positioned in a blank area of the continuous sheet, the reflected intensity from the continuous sheet is high, and as illustrated in FIG. 3B, a detected value of the cut mark sensor 12 is also stabilized at a high value. After that, when the black solid cut mark is started to be included in the detection area S, the detected value starts to decrease, and when the detected area S is completely included in the cut mark, the detected value is stabilized at a low value. As described, in the process of drastically changing from the high detected value to the low detected value, a point when the detected value becomes lower than a threshold value K can be determined as a point when the cut mark M has passed.

Figures 4A, 4B, 4C, 4D:
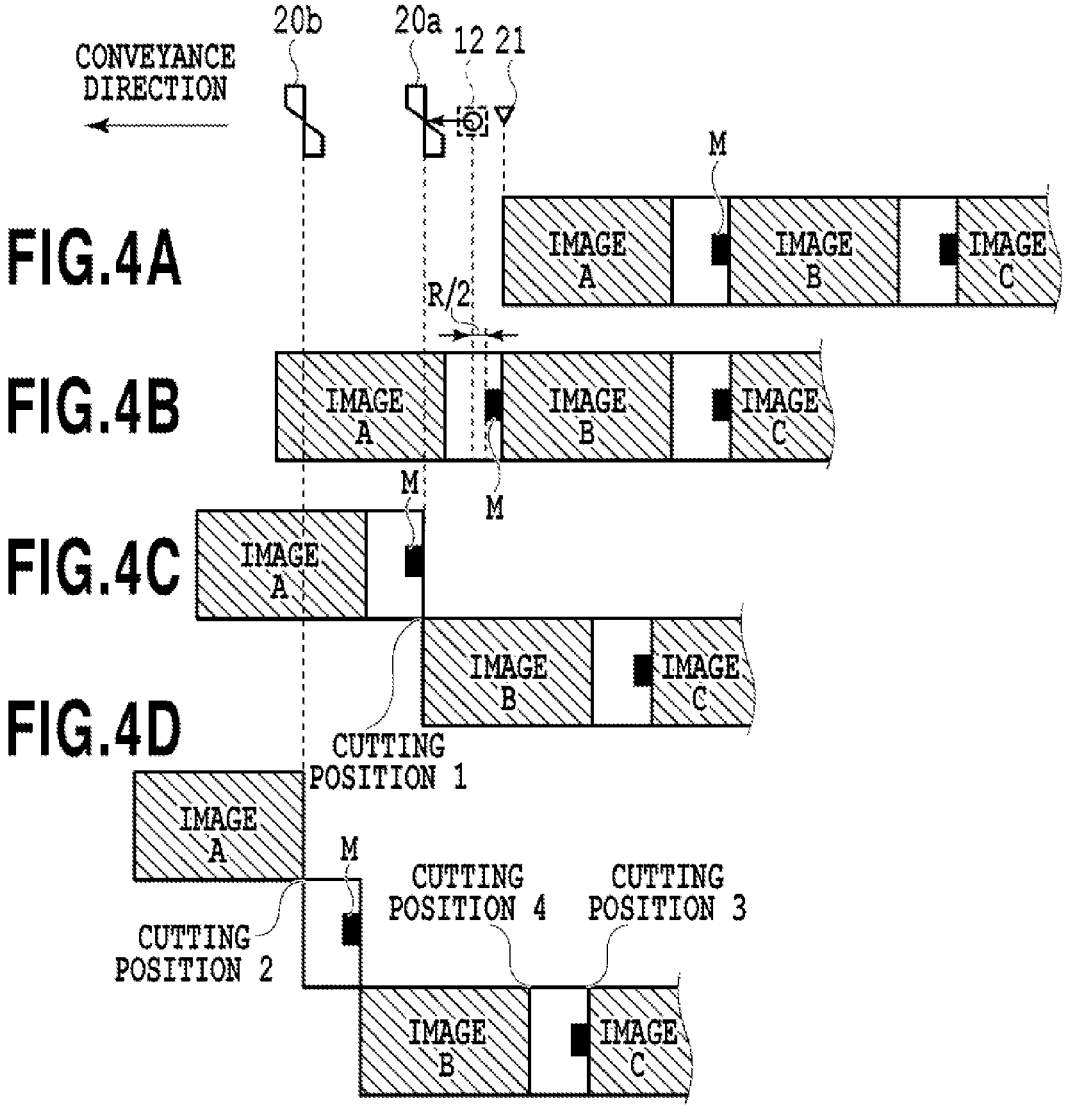
FIGS. 4A to 4D are diagrams illustrating the detection of a cut mark and a cutting operation associated with the detection.

FIGS. 4A to 4D are diagrams illustrating the detection of a cut mark M in the cutter unit 5 and a cutting operation associated with the detection. FIG. 4A illustrates a state where a fore end of a printed continuous sheet arrives at the edge sensor 21 of the cutter unit 5. At the timing of the arrival, the control unit 8 stops a detecting operation of the cut mark sensor 12 or confirms that the cut mark sensor 12 has been stopped.

FIG. 4B illustrates the timing when the cut mark sensor 12 starts the detecting operation. The detecting operation is performed in a range of a detecting range length R that is around an area where the cut mark M is supposed to be detected and enough to include a conveyance error, and started from a position precedent by R/2 to a position where the cut mark M is supposed to be detected. Also, such a detecting range length R including the conveyance error is adjusted by the control unit 8 depending on the length of an image to be precedently printed. In the following, the case of FIG. 4B is specifically described.

The control unit 8 estimates a conveyance amount of the continuous sheet based on a driving amount of a conveyance motor after the edge sensor 21 detected the fore end part of the sheet. However, in the continuous sheet, slipping, meandering, and the like occur, and therefore between the conveyance amount estimated by the control unit 8 and an actual conveyance amount, a certain amount of error occurs. Further, such an error increases along with an increase in conveyance amount after the edge sensor 21 detected the fore end part of the sheet, i.e., along with an increase in length of an image A in a conveyance direction. Accordingly, in the present embodiment, the detecting range length R including such a conveyance error is set depending on the length of the image A to be precedently printed.

After the cut mark M has been detected, with reference to a position where the cut mark M was detected, the control unit 8 uses the two cutters 20*a* and 20*b* to cut a fore end of an image B (page) and a rear end of the image A (page). Assuming here that the fore end of the image B corresponds to a cutting position 1, and the rear end of the image A corresponds to a cutting position 2, after cutting in the cutting position 1 has been performed with the cutter 20*a* arranged on an upper stream side, cutting in the cutting position 2 is performed with the cutter 20*b* arranged on a lower stream side. FIG. 4C illustrates a state where the cutting in the cutting position 1 has been performed, whereas the cutting in the cutting position 2 is not yet performed, and FIG. 4D illustrates a state where the cutting in the cutting position 2 has also been performed.

When the cutters 20*a* and 20*b* respectively perform the cutting operations, a conveyance operation of the sheet is temporarily stopped. However, a region where the sheet conveyance is stopped is limited only to the cutter unit 5, and in the respective units on upstream and downstream sides of the cutter unit 5, the conveyance operation is kept. At this time, a sheet conveyed on the downstream side of the cutter unit 5 has already formed into a cut sheet, and therefore conveyance control of the whole of the apparatus is not influenced. Further, regarding the continuous sheet on the upstream side of the cutter unit 5, although the sheet is slightly bent near a gate to the cutter unit 5, an amount of the bend is a little, and not enough to influence a printing position in the printing unit 4 as well.

The above-described two-step cutting causes the continuous sheet to be separated into an image area where the image according to image data is printed and a non-image area where the cut mark and/or a maintenance pattern are printed. Then, the image area is conveyed to the tray 6 as a cut sheet, whereas the non-image sheet is contained in the trash box 11. After that, the same process as above is also performed on the image B and image C subsequent to the image A, and the separation between a cut sheet as an image area and a non-image sheet is repeated.

In order to reliably detect the cut mark M without erroneously detecting a pattern in an image as the cut mark as described, preferably, at the timing when the cut mark sensor 12 starts the detecting operation, the detection area S is positioned in a blank area of the non-image area C. Accordingly, the control unit 8 determines the detecting range length R so as to include a conveyance error supposed from the length of the image to be precedently printed, and prepares the non-image area C corresponding to the detecting range length R. Then, the control unit 8 sets a position located upstream of the cut mark M by R/2 as a detecting operation starting position of the cut mark sensor. Such a timing adjustment made by the control unit 8 enables a clear detected result as in FIG. 3B to be obtained.

Note that without necessarily preparing the non-image area C corresponding to the image to be precedently printed as described with FIG. 3A or as in Japanese Patent Laid-Open No. 2012-158122, the clear detected result as in FIG. 3B can be obtained. To specifically describe this, a state of stabilizing the detected value at a high value is, without limitation to a non-image area, also obtained in a blank part of an actual image, and even in the case where a cut mark is disposed immediately after the blank part, a locus of the detected value as in FIG. 3B is obtained. Also the range where the detecting operation of the cut mark sensor is performed does not necessarily include only a part where a transfer from a stabilized high detected value to a stabilized low detected value is made. Even in the case where within the detecting range, an image irrelevant to a cut mark is present, as long as a point possibly erroneously sensed as a cut mark is not present, and a part where a transfer from a stabilized high detected value to a stabilized low detected value is made is included, a cut mark can be normally detected. In consideration of the above description, the present inventors have determined that a non-image area can be reduced by starting the detecting operation of the cut mark sensor from the vicinity of a rear end part of an actual image even though obtaining a stabilized high detected value from the rear end part of the actual image, or removing a result of detection in the vicinity of the rear end part. In the following, distinctive control of the present invention is described in detail.

Figure 5:
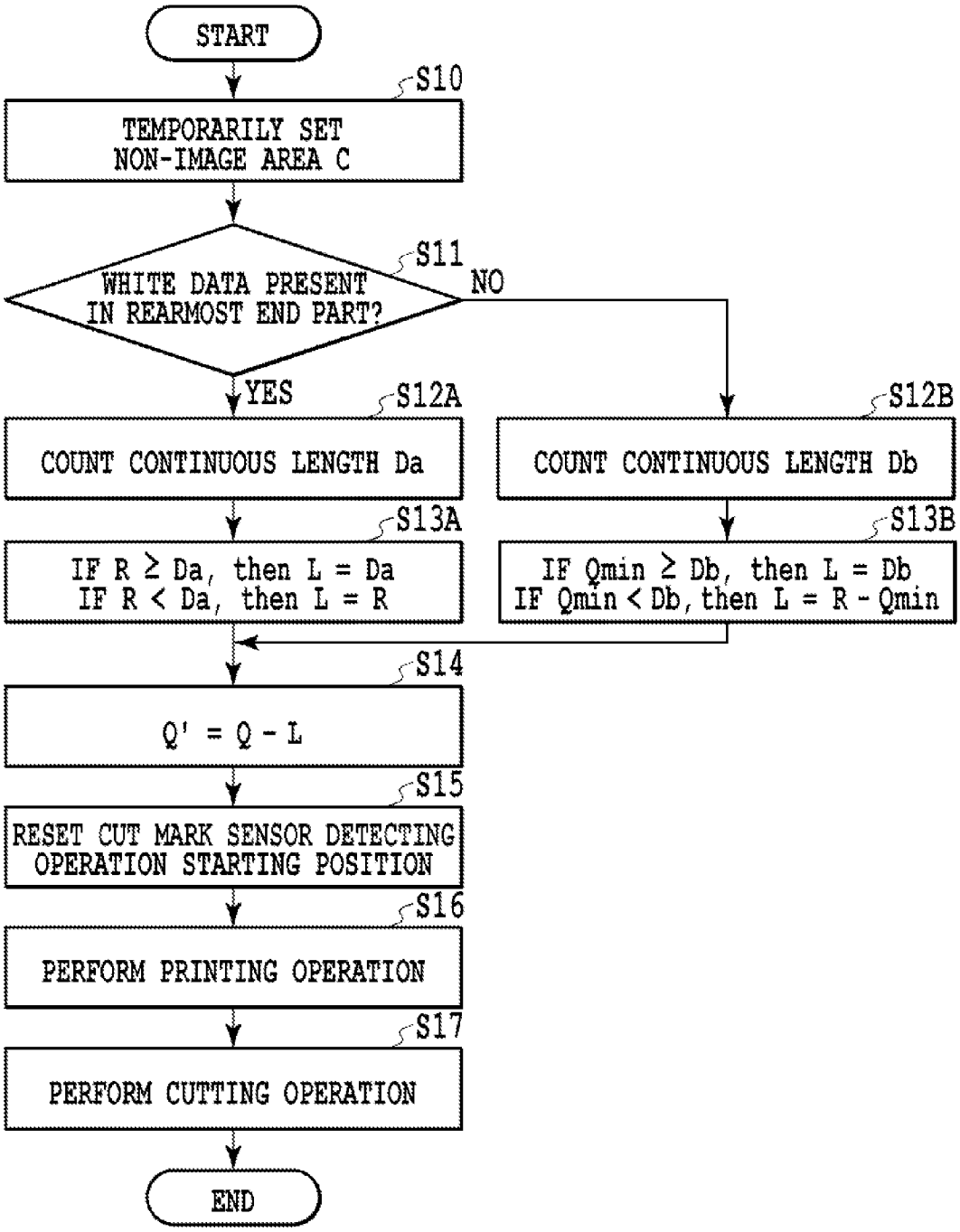
FIG. 5 is a flowchart for describing steps of a cutting process in a first embodiment.

FIG. 5 is a flowchart for describing steps of a cutting process performed by the control unit 8. Also, FIGS. 6A and 6B, or FIGS. 7A and 7B are schematic diagrams for describing a layout example of an image area and a non-image area, which is generated in the present embodiment, with comparing the layout example with a conventional example.

In FIG. 5, after the process has been started, first, in Step S10, the control unit 8 uses the image analyzing unit 7 to analyze image data on a target image P, and on the basis of the length I of the image P in the conveyance direction, sets a detecting range length R taking into account a conveyance error amount. Then, the control unit 8 temporarily sets a non-image area C, which has a length of N calculated by adding a cut mark M to the detecting range length R, immediately after the target image P (see FIGS. 6A and 7B). Further, the control unit 8 temporarily sets a position where the cut mark sensor 12 starts the detecting operation to a position located upstream of a supposed fore end position of the cut mark M by approximately R/2.

In Step S11, the control unit 8 uses the image analyzing unit 7 to analyze the image data on the target image P, and determines whether or not a blank area (white data) is present in a position that is in a rear end part of the target image P and the detection area of the cut mark sensor 12 passes.

Figure 6A:
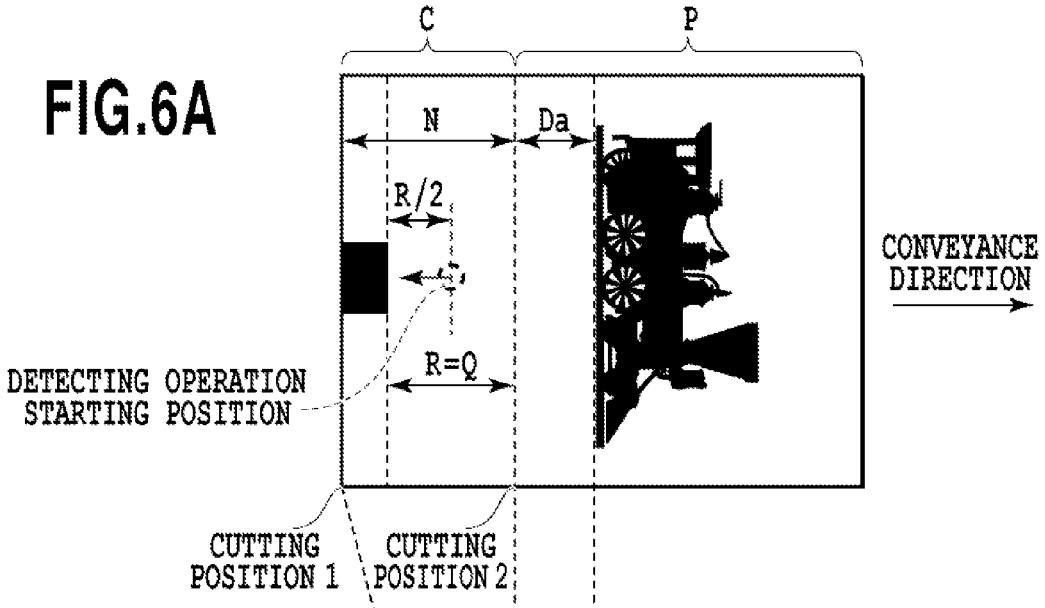
FIGS. 6A and 6B are diagrams each illustrating a layout example of an image area and a non-image area.

In the case of an image as in FIG. 6A, the control unit 8 determines that the blank area is present in the rear end part of the image, and the process proceeds to Step S12A. Then, the control unit 8 counts a length (the number of pixels) Da by which the blank area continues in the conveyance direction, and in Step S13, on the basis of Da, sets a reduction length L of the non-image area C. Specifically, in the case where the length Da of the blank area in the image is equal to or less than a length R of a blank area of the non-image area C ($R \geq Da$), the control unit 8 sets L as $L=Da$. On the other hand, in the case where the length Da of the blank area in the image is larger than the length Q of the blank area of the non-image area C ($R<Da$), the blank area of the actual image cannot be reduced, and therefore the control unit 8 sets L as $L=R$.

Figure 7A:
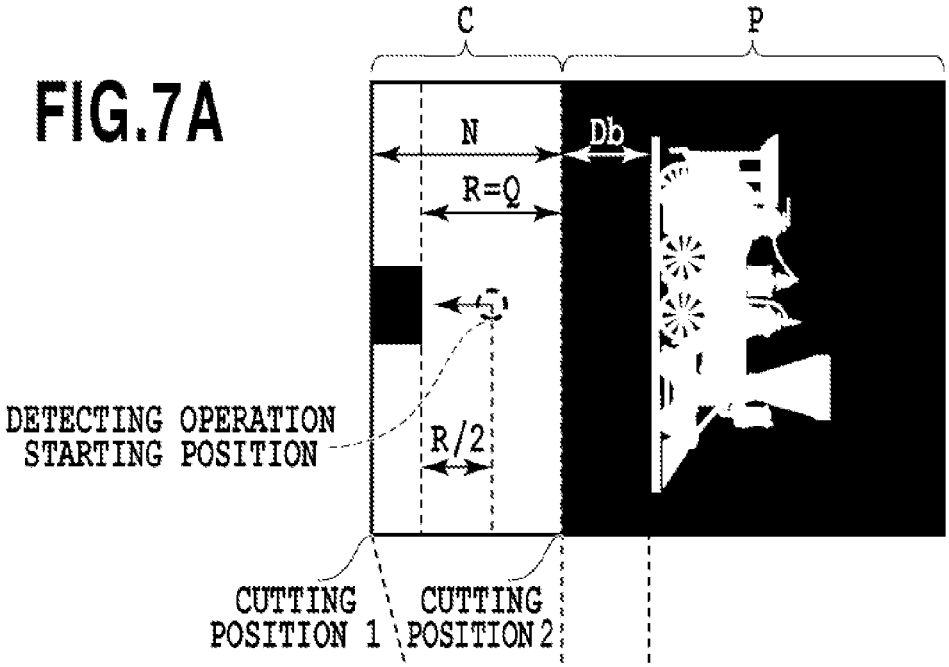
FIGS. 7A and 7B are diagrams each illustrating a layout example of an image area and a non-image area.

On the other hand, in Step S11, in the case of an image as in FIG. 7A, the control unit 8 determines that a blank area (white data) is not present in a rear end part of the target image P, and the process proceeds to Step S12B. Then, the control unit 8 counts an area from a rearmost end part of the image P, which has the same level of density, specifically, counts a length (the number of pixels) Db by which "a density stabilization area where density is stabilized to the extent not erroneously sensed as a cut mark" continues in the conveyance direction. In subsequent Step S13B, on the basis of Db, the control unit 8 sets a reduction length L of a non-image area. Specifically, given that a minimum required size for a blank area arranged immediately before a cut mark to be recognized as "white" is Qmin, in the case where the size Db of the density stabilization area in the image is equal to or less than Qmin ($Qmin \geq Db$), the control unit 8 sets L as $L=Db$. On the other hand, in the case where the size Db of the density stabilization area in the image is larger than Qmin ($Qmin<Db$), in order to ensure the minimum required blank area Qmin, the control unit 8 sets L as $L=R-Qmin$.

After the control unit 8 has set the reduction length L of the non-image area in Step S13A or S13B, the process performed by the control unit 8 proceeds to Step S14, where the non-image area temporarily set in Step S10 is reduced from a fore end thereof by the reduction length L. As a result, referring to FIG. 6B or 7B, the length of a new non-image area C' is $N'=N-L$, and the length of the blank area given immediately before the cut mark M is $Q'=Q-L$, so that the control unit 8 resets a layout of the non-image area C' on the basis of the lengths. Further, in Step S15, on the basis of the layout newly set in Step S14, the control unit 8 resets a timing position to start the detecting operation of the cut mark sensor 12 to a position located upstream of a supposed fore end position of the cut mark M by approximately R/2. In doing so, the detecting operation starting position of the cut mark sensor 12 is located, in the case of FIG. 6B, in the blank area near the rear end part of the image P, or in the case of FIG. 7B, in the image printing area near the rear end part of the image P.

In Step S16, the control unit 8 uses the printing unit 4 to print the image and the cut mark according to the blank area set in Step S14 and the image data on the target image P. Further, in Step S17, the control unit 8 uses the cutter unit 5 to perform the cutting process according to the method described with FIG. 4. That is, the control unit 8 performs the detecting operation by the cut mark sensor 12, and on the basis of a result of the detecting operation, performs the cutting process. This process ends here.

Figure 6B:
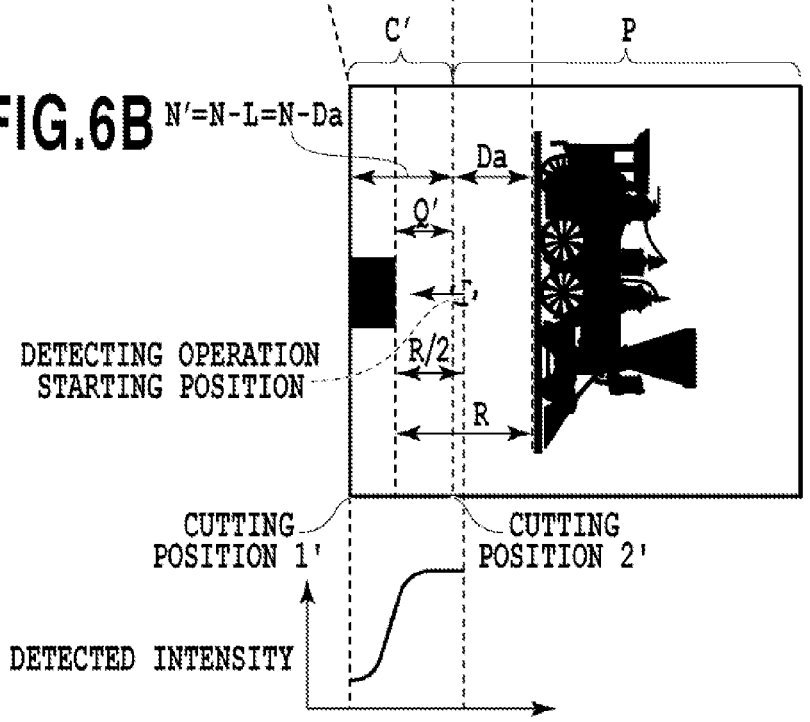

Now, in comparing FIGS. 6A and 6B with each other, in FIG. 6B, the length of the non-image area C' is made shorter than that in FIG. 6A by the length Da of the blank area in the image; however, the blank area is sufficiently ensured from a fore end of the cut mark to a position located upstream of the fore end by R. Accordingly, even in the case where a certain amount of conveyance error occurs, the detected result of the cut mark sensor 12 clearly changes in the order of "high→low" from the position to start reading as illustrated in a lower part of FIG. 6B, and therefore a location of the cut mark can be accurately determined.

Figure 7B:
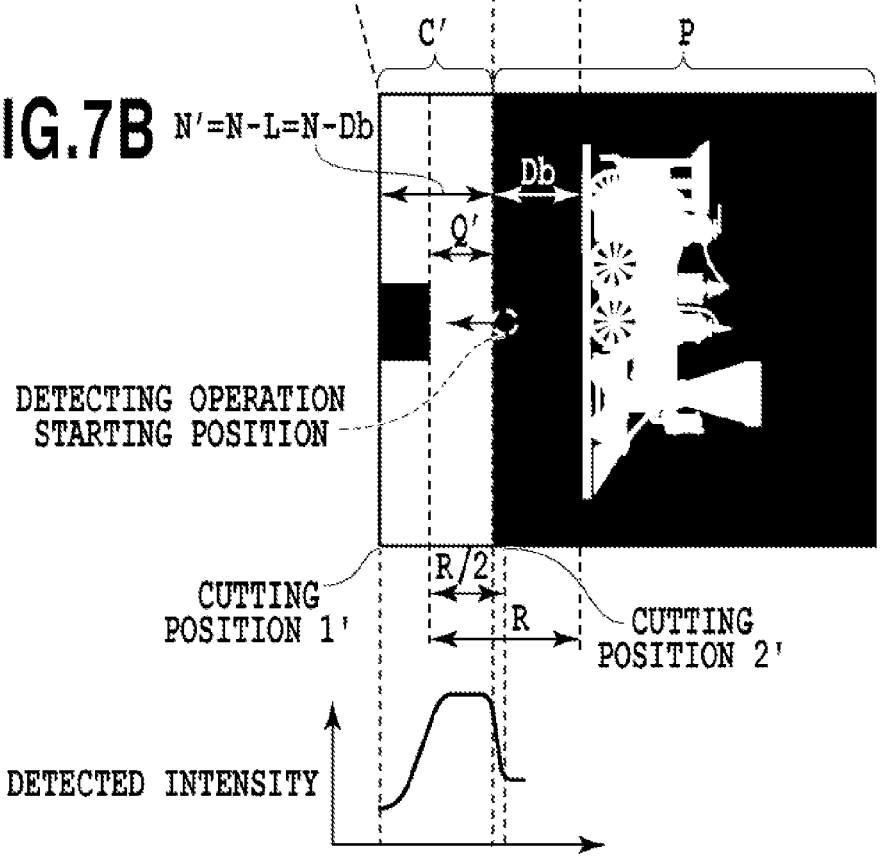

Also, in comparing FIGS. 7A and 7B with each other, in FIG. 7B, the length C' of the non-image area is made shorter than that in FIG. 6A by the size Db of the density stabilization area in the image. On the other hand, in the detection area of the cut mark sensor, an actual image that is possibly erroneously sensed as a cut mark is not included, and the blank area is sufficiently ensured from a fore end of the cut mark to a position located upstream of the fore end by at least Qmin. Accordingly, even in the case where a certain amount of conveyance error occurs, the result of detecting the cut mark clearly changes in the order of "low→high→low" from the position to start reading as illustrated in a lower part of FIG. 7B. Further, in the case where drawing a fixed locus as described is preliminarily known, by preliminarily removing the first half of the change, i.e., "low→high" from the determination of the cut mark, the cut mark can be accurately detected on the basis of the second half of the change, i.e., "high→low". That is, according to the present embodiment, even in the case of an image as in FIG. 6 or FIG. 7, the non-image area consequently discarded can be kept to a minimum with an area necessary to accurately perform the cut mark detecting operation being left, and therefore running cost can be made smaller than before.

According to examination by the present inventors, by employing the present embodiment, in the case of printing an L size image (3.5×5 inches) on a roll sheet having a width of 5 inches, the length of a cut mark margin can be shortened from 3 mm to 1 mm. As a result, in the case of successively printing 1000 images, a consumption amount of the roll paper can be reduced by 2 m from a conventional consumption amount.

Second Embodiment

In the first embodiment, depending on whether or not a blank area is present in the rear end part of the image P to be precedently printed, a method for analyzing an image in the rear end part is made different. Note that the presence or absence of a cut mark is actually determined depending on whether or not the detected result of the cut mark sensor 12 exceeds the predetermined threshold value. Accordingly, in the present embodiment, not depending on whether or not a blank area is present in a rear end part of an image P, but depending on whether or not an image area where a threshold value is exceeded is present, a method for analyzing an image in a rear end part is made different.

Figure 8:
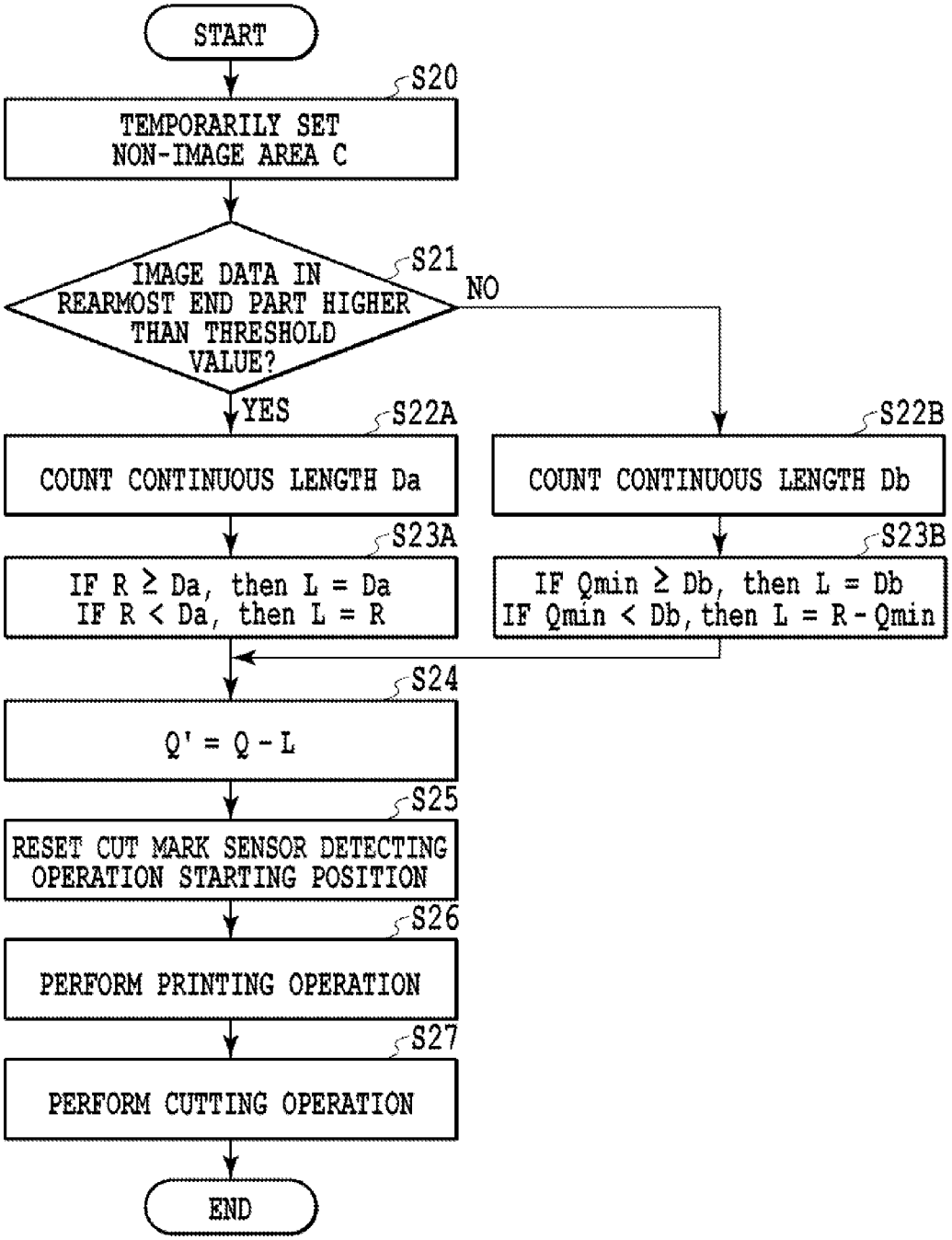
FIG. 8 is a flowchart for describing steps of a cutting process in a second embodiment.

FIG. 8 is a flowchart for describing steps of a cutting process performed by a control unit 8 in the present embodiment. Also, FIGS. 9A and 9B are diagrams illustrating examples of images P to be precedently printed and detected results of detecting the images P with the cut mark sensor 12, respectively.

After the process has been started, first, in Step S20, the control unit 8 uses an image analyzing unit 7 to analyze image data on a target image P, and on the basis of the length I of the image P in a conveyance direction, sets a detecting range length R taking into account a conveyance error amount. Then, the control unit 8 temporarily sets a non-image area C, which has a length of N calculated by adding a cut mark M to the detecting range length R, immediately after the target image P. Further, the control unit 8 temporarily sets a position where the cut mark sensor 12 starts a detecting operation to a position located upstream of an assumed fore end position of the cut mark M by approximately R/2.

In Step S21, the control unit 8 uses the image analyzing unit 7 to analyze the image data on the target image P, and determines whether or not a detected value in the case of detecting an image in a rear end part of the target image P with the cut mark sensor 12 is higher than a threshold value K.

Figure 9A:
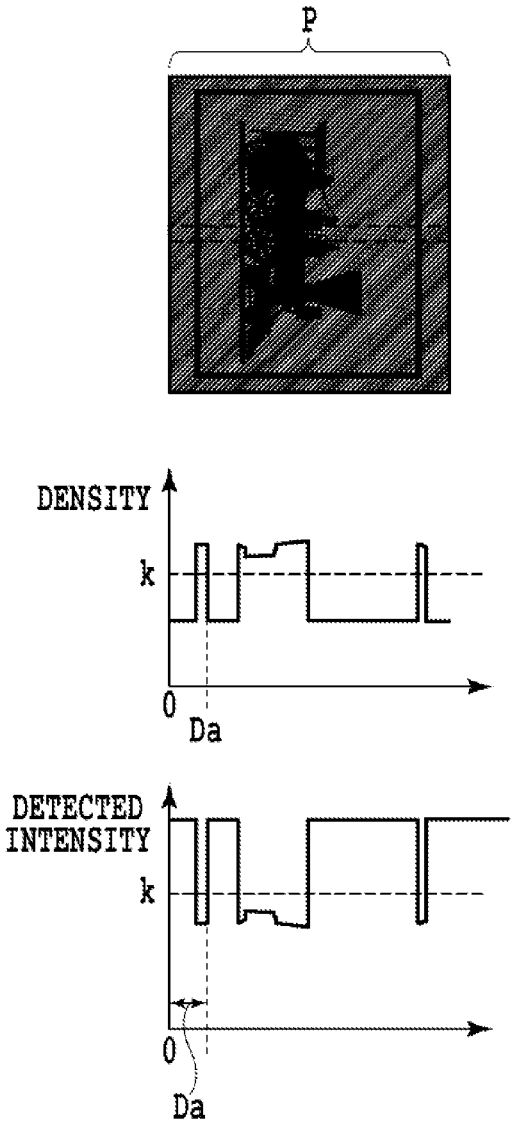
FIGS. 9A and 9B are diagrams each illustrating an image example and a detected result of a cut mark sensor.
Figure 9B:
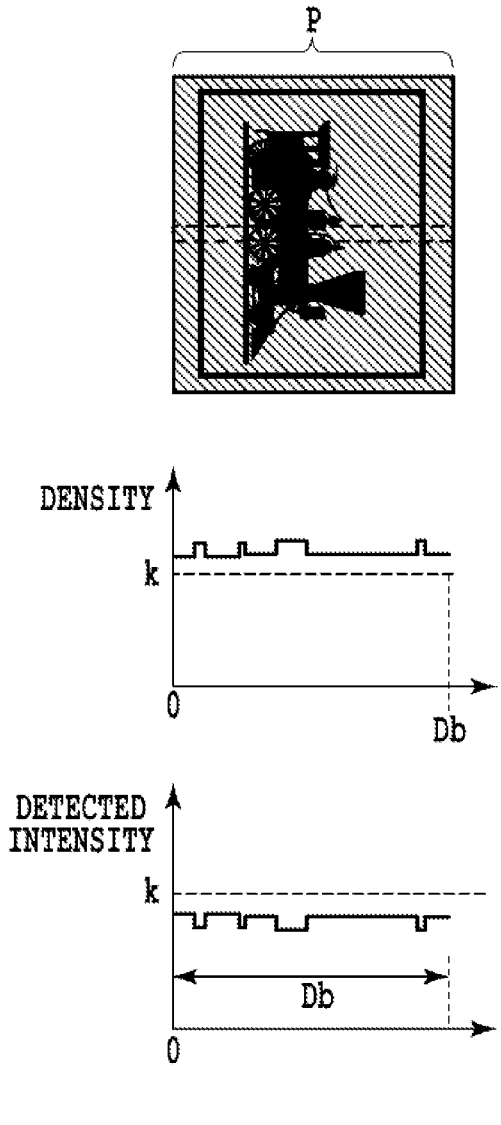

In the case where the target image P is as in FIG. 9A, the control unit 8 determines that the detected value in the rear end part is higher than the threshold value K, and the process proceeds to Step S22A. In Step S22A, the control unit 8 counts a length Da by which an area where the detected value is higher than the threshold value K continues in the conveyance direction, and in Step S23A, on the basis of Da, sets a reduction length L of the non-image area C. Specifically, in the case where the length Da of the blank area in the image is equal to or less than the length R of a blank area in the non-image area C (R≥Da), the control unit 8 sets L as L=Da. On the other hand, in the case where the length Da of the blank area in the image is larger than the length Q of the blank area in the non-image area C (R<Da), the blank area in the actual image cannot be reduced, and therefore the control unit 8 sets L as L=R. In the example of FIG. 9A, a distance from the rear end part of the image P to a position of a black frame is Da, and L is set as L=Da.

On the other hand, in the case where the target image P is as in FIG. 9B, in Step S21, the control unit 8 determines that the detected value in the rear end part is lower than the threshold value K, and the process proceeds to Step S22B. In Step S22B, the control unit 8 counts a length Db by which an area where the detected value does not exceed the threshold value K continues from the rearmost end part of the image P in the conveyance direction. Further, in Step S23, on the basis of Db, the control unit 8 sets a reduction length L of a non-image area. Specifically, as in the first embodiment, in the case where Db is equal to or less than Qmin (Qmin≥Db), the control unit 8 sets L as L=Db, whereas in the case where Db is larger than Qmin (Db>Qmin), the control unit 8 sets L as L=R−Qmin. In the example of FIG. 9B, a distance throughout the image P is Db, and therefore L is set as L=R−Qmin.

Subsequent steps are the same as those in the first embodiment. That is, the process performed by the control unit 8 proceeds to Step S24, where the control unit 8 reduces the non-image area C temporarily set in Step S20 from a fore end of the non-image area C by the reduction length L. As a result, the length of a new non-image area C' is N'=N−L, and the length of a blank area given immediately before the cut mark M is Q'=Q−L, so that the control unit 8 resets a layout of the non-image area C' on the basis of the lengths. Further, in Step S25, on the basis of the layout newly set in Step S24, the control unit 8 resets a timing position to start the detecting operation of the cut mark sensor 12 to a position located upstream of an assumed fore end position of the cut mark M by approximately R/2. In doing so, the position to start the detecting operation of the cut mark sensor 12 is located within an area of the image P in any of the cases of FIGS. 9A and 9B.

Further, in Step S26, the control unit 8 uses a printing unit 4 to print the image and the cut mark according to the blank area set in Step S24 and the image data on the target image P. Still further, in Step S27, the control unit 8 uses a cutter unit 5 to perform a cutting operation according to the method described with FIG. 4. This process ends here.

According to the present embodiment described above, in the case of an image as in FIG. 9A, even though the non-image area is reduced by Da, in the detection area of the cut mark sensor 12, the detected result clearly changes as "high→low" with respect to the threshold value K, and therefore the cut mark can be accurately detected. Also, in the case of an image as in FIG. 9B, even though the non-image area is reduced to Qmin in size, the detected result of the cut mark sensor 12 clearly changes in the order of "low→high→low" with respect to the threshold value K, and therefore the cut mark can be accurately detected.

Third Embodiment

In the second embodiment, depending on whether or not an image area where the threshold value is exceeded is present in the rear end part of the image P, a method for analyzing an image in the rear end part is made different. Further, the length Da by which the image area where the threshold value is exceeded continues, or the length Db by which the image area where the threshold value is not exceeded continues is set as the reduction length L. However, in this case, if an area where a change in density is drastic is present in the rear end part, the reduction length L becomes extremely short, and therefore the effect of the present invention is unlikely to appear. On the other hand, in the present embodiment, described is a configuration where even in the case where a density variation that crosses a threshold value up and down is present in a rear end part of an image, a certain amount of reduction length L can be ensured.

Figure 10A:
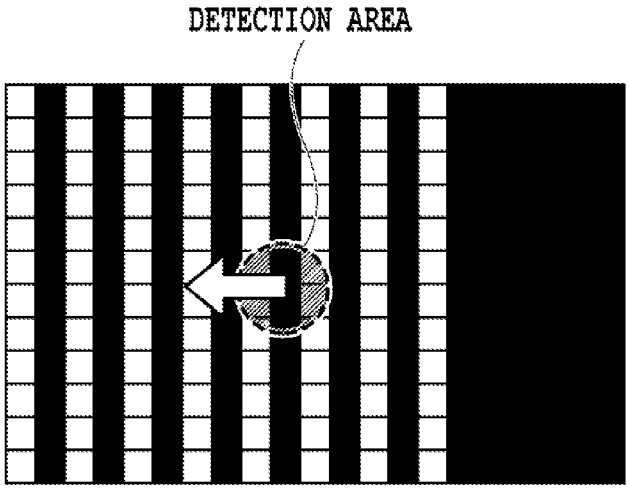
FIGS. 10A and 10B are diagrams illustrating an image example and a detected result of the cut mark sensor.
Figure 10B:
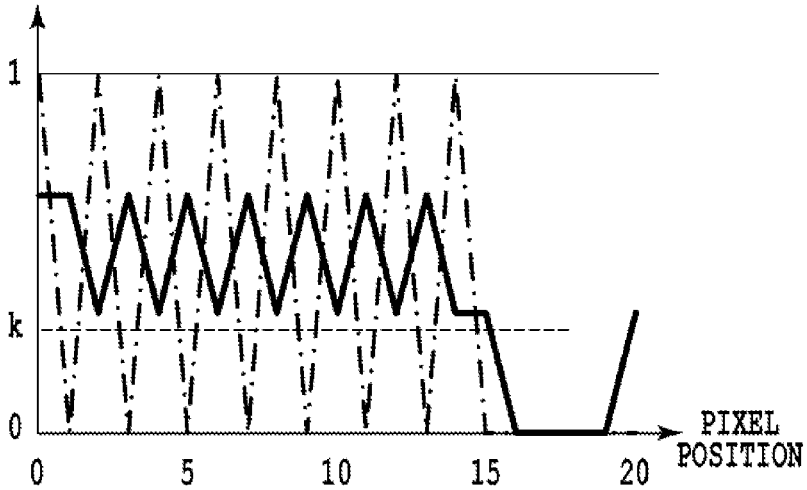

FIGS. 10A and 10B are diagrams illustrating image data and a detected result of a cut mark sensor in the case where in a rear end part of an image, ruled lines are successively printed. In FIG. 10A, each square represents one pixel area in the image data. In this case, if a detection area of the cut mark sensor 12 is within one pixel area, a detected result of the cut mark sensor 12 behaves like a dashed dotted line in FIG. 10B. That is, a detected value of the cut mark sensor changes so as to cross a threshold value K up and down, and therefore each of the ruled lines is at risk of being determined as a cut mark.

However, a detection area of an actual cut mark sensor 12 often has an area larger than one pixel area. For example, in the case where a diameter of the detection area is the total length of approximately three pixels, a detected result behaves like a solid line in FIG. 10B. That is, a detected value of the cut mark sensor changes without crossing the threshold value K, and therefore any of the ruled lines is not at risk of being determined as a cut mark.

Accordingly, an image analyzing unit 7 of the present embodiment obtains a moving average value of three pixels with respect to image data on a target image P, and determines whether or not the moving average value is higher than the threshold value K. In this case, the moving average value in a conveyance direction behaves like the solid line in FIG. 10B, and does not fall below the threshold value K. In the present embodiment, such an area is regarded as an area where the moving average value is higher than the threshold value, and in the flowchart of FIG. 8 described in the second embodiment, the process proceeds to Step S22A. As a result, the whole of a ruled line area can be included in the continuous area Da where the detected result is higher than the threshold value K. The same holds true for the case where the moving average value is lower than the threshold value K. In this case, the process proceeds to Step S22B, and the whole of the ruled line area can be included in the continuous area Db where the detected result is lower than the threshold value K. Further, in either case, as compared with the second embodiment that does not calculate the moving average value, Da or Db, i.e., the reduction length L can be increased, and therefore the length of a non-image area to be consequently discarded can be kept small.

Note that in the above, the detection area of the cut mark sensor is assumed to correspond to three pixels, and therefore correspondingly to this, the number of pixels used for the moving average is also three; however, it should be appreciated that the number of pixels used for the moving average is not limited to this. In the case where the diameter of the detection area of the cut mark sensor is the total length of five pixels, correspondingly to this, the number of pixels used for the moving average (hereinafter also referred to as "a moving average number") can also be set to five. Further, as long as being included in an area sufficiently smaller than a size of the cut mark, the moving average number can be set even larger than a diameter of the detection area of the cut mark sensor.

Figure 11A:
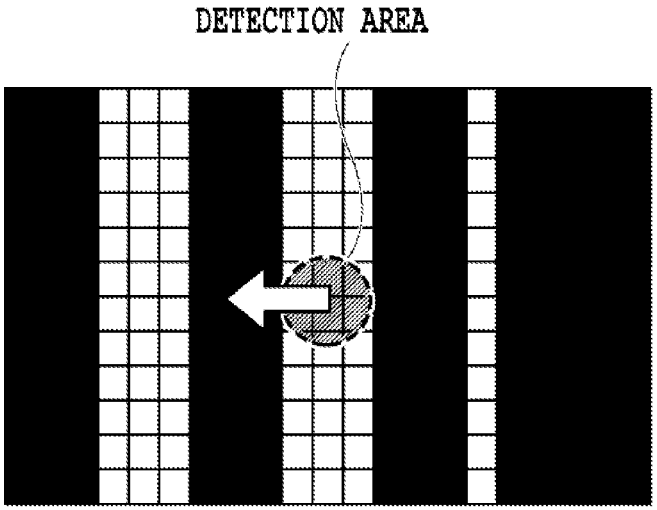
FIGS. 11A and 11B are diagrams illustrating an image example and a detected result of the cut mark sensor.
Figure 11B:
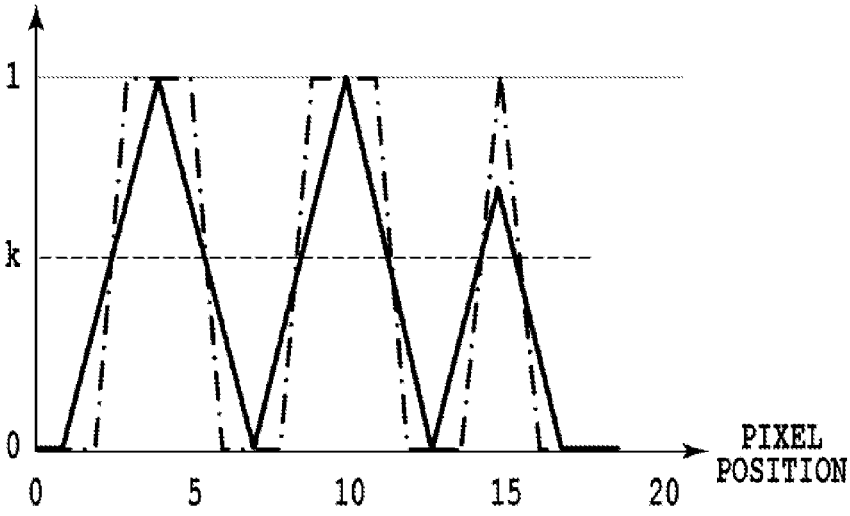

FIGS. 11A and 11B are diagrams illustrating the case where ruled lines each having a three-pixel width are successive in a rear end part of an image in a configuration where the diameter of the detection area (corresponding to three pixels) of the cut mark sensor is fitted with the moving average number (three pixels). In this case, even in the case of performing the three-pixel moving average, the detected value of the cut mark sensor largely varies so as to cross the threshold value K up and down, and therefore for Da or Db, only three pixel-width area can be ensured. However, even in such a case, if it is known in advance that the cut mark M itself has length sufficiently longer than the total length of three pixels, the moving average number can also be further increased to further largely ensure an area where the threshold value is not exceeded, i.e., the reduction length L.

Note that each of the above embodiments is described on the premise that, as in Japanese Patent Laid-Open No. 2012-158122, in Step S10 of FIG. 5 or in Step S20 of FIG. 8, on the basis of the length I of the image P precedently conveyed in the conveyance direction, the detecting range length R taking into account the conveyance error amount is set; however, the present invention is not limited to such a configuration. That is, in such a step, even in the case of a configuration where the length R of the non-image area is set to a constant amount regardless of the length of the image, the effect of the present invention, which is capable of reducing the non-image area to be consequently discarded, can be produced.

Also, each of the above embodiments is described on the basis of a configuration where on the basis of one cut mark, fore and rear end parts of a non-image area are respectively cut with the different cutters; however, the cut mark can also be specially prepared for each of the cut mark sensors. Also, the cut mark is not necessarily printed by the print head 14 in the printing unit 4. For example, the present invention may provide a dedicated mark forming unit separately from the print head 14, or may be configured to make a small hole in a sheet. In the latter case, the detected value of the light receiver is decreased at the timing when irradiated light passes through the hole, and thereby a location of the cut mark can be determined.

Further, the above is described on the basis of a configuration where the cut mark sensor is set as a luminance sensor, and with reference to each of FIGS. 3, 6, and 7, and other drawings, the detected value of the cut mark sensor is high in a blank area, whereas the detected value is low in a cut mark part. However, the cut mark sensor of the present invention may be one that detects density. In this case, the detected value of the cut mark sensor is low in a blank area, whereas the detected value is high in a cut mark or image area, and therefore the locus of the detected result illustrated in each of FIGS. 3, 6, and 7, and other drawings is vertically reversed. Even in this case, in the case where the detected value changes across a predetermined threshold value, it can be determined that a cut mark passes, and therefore the same effect as that in each of the above embodiments can be obtained.

Still further, in the above, the full line type printing apparatus of the inkjet system is taken as an example to provide the description; however, the present invention is not limited to such a configuration. Obviously, the number of ink colors is not limited. Also, the printing apparatus may be a serial type one, and as a printing system, various systems such as an electrophotographic system, thermal transfer system, dot impact system, and liquid development system can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-085957, filed Apr. 16, 2013, which is hereby incorporated by reference herein in its entirety.

What is claimed is:

1. A printing method comprising:

printing a plurality of images on a continuous sheet and forming a mark in a non-image area between adjacent two images; and cutting the sheet on a basis of a detection of the mark, wherein a length of the non-image area is set on a basis of image data in a rear end part of a precedent image of the two images, and a position where a mark detecting operation in the non-image area is started, is determined on a basis of the length of the non-image area.

2. The printing method according to claim 1, wherein the length of the non-image area in a conveyance direction is set temporarily on a basis of length of the precedent image in the conveyance direction, in a case where the image data in the rear end part of the precedent image is white data, the length set temporarily is reduced depending on a number of pixels by which the white data continues in the conveyance direction, and in a case where the image data in the rear end part of the precedent image is not white data, the length set temporarily is reduced depending on the data that is not the white data.

3. The printing method according to claim 1, wherein the length of the non-image area in a conveyance direction is set temporarily on a basis of length of the precedent image in the conveyance direction, in a case where the image data in the rear end part of the precedent image has a value higher than a predetermined threshold value, the length set temporarily is reduced depending on a number of pixels by which the data having the value higher than the threshold value continues in the conveyance direction, and in a case where the image data in the rear end part of the precedent image has a value lower than the predetermined threshold value, the length set temporarily is reduced depending on a number of pixels by which the data having the value lower than the threshold value continues in the conveyance direction.

4. The printing method according to claim 1, wherein a moving average value in a conveyance direction of the image data in the rear end part of the precedent image is obtained, the length of the non-image area in the conveyance direction is set temporarily on a basis of length of the precedent image in the conveyance direction, in a case where the moving average value in the rear end part of the precedent image is a value higher than a predetermined threshold value, the length set temporarily is reduced depending on a number of pixels by which the moving average value continues in the conveyance direction, and in a case where the moving average value in the rear end part of the precedent image is a value lower than the predetermined threshold value, the length set temporarily is reduced depending on a number of pixels by which the moving average value continues in the conveyance direction.

5. The printing method according to claim 1, wherein printing of the images and forming of the mark are performed with a print head of an inkjet type.

6. The printing method according to claim 1, wherein the mark is detected on a basis of a change in received intensity of reflected light from the continuous sheet.

7. A printing apparatus comprising:

a printing unit configured to print a plurality of images on a continuous sheet, and form a mark in a non-image area between adjacent two images;

a cutting unit configured to cut the sheet on a basis of detection of the mark; and a controller for controlling the printing unit and the cutting unit, wherein the controller controls the printing unit to set a length of the non-image area on a basis of image data in a rear end part of a precedent image of the two images, and determines a position where a mark detecting operation in the non-image area is started on a basis of the length of the non-image area.

* * * * *